US005984380A

United States Patent [19]

Rice

[11] Patent Number: 5,984,380

[45] Date of Patent: Nov. 16, 1999

[54] TETHER ASSEMBLY

[75] Inventor: Brian J. Rice, Columbia City, Ind.

[73] Assignee: Access Denied, Inc., Columbia City, Ind.

[21] Appl. No.: 08/649,362

[22] Filed: May 17, 1996

[51] Int. Cl.[6] ..... E05C 21/00

[52] U.S. Cl. ..... 292/1; 292/92; 292/259 R; 292/264; 24/135 N; 24/298; 248/328

[58] Field of Search ..... 292/264, 1, 259 R, 292/92; 248/104, 328; 24/298, 135 N

[56] References Cited

U.S. PATENT DOCUMENTS

| | | | |
|---|---|---|---|
| 166,620 | 8/1875 | Martin | 292/259 |
| 264,298 | 9/1882 | Johnson . | |
| 312,580 | 2/1885 | O'Malley . | |
| D. 347,157 | 5/1994 | Brown . | |
| 412,749 | 10/1889 | Hayes | 24/135 N |
| 531,784 | 1/1895 | Crosby . | |
| 1,273,922 | 7/1918 | Prattinger | 24/135 N |
| 2,015,403 | 9/1935 | Kiddle . | |
| 2,272,852 | 2/1942 | Schaefer . | |
| 2,300,913 | 11/1942 | Flaherty . | |
| 2,395,204 | 2/1946 | Symons . | |
| 3,268,965 | 8/1966 | Arthur . | |
| 3,819,216 | 6/1974 | Richardson . | |
| 3,863,968 | 2/1975 | Fraser . | |
| 4,082,332 | 4/1978 | Palmer . | |
| 4,342,477 | 8/1982 | McClure . | |
| 4,564,230 | 1/1986 | Haist | 292/264 X |
| 4,601,503 | 7/1986 | Wicks, Sr. . | |
| 4,856,831 | 8/1989 | Roden, Jr. . | |
| 5,052,648 | 10/1991 | Landau | 248/328 X |
| 5,077,940 | 1/1992 | LaRose, Jr. . | |
| 5,232,254 | 8/1993 | Teaff | 292/259 R |
| 5,253,905 | 10/1993 | Hutson . | |
| 5,364,140 | 11/1994 | Rice . | |
| 5,447,345 | 9/1995 | Daley | 292/259 R |
| 5,490,686 | 2/1996 | Hutson . | |
| 5,496,081 | 3/1996 | Rice . | |

FOREIGN PATENT DOCUMENTS

| | | | |
|---|---|---|---|
| 46-51 | 1/1971 | Japan | 24/135 N |
| 27929 | 12/1907 | United Kingdom | 24/135 N |

*Primary Examiner*—Rodney M. Lindsey
*Attorney, Agent, or Firm*—Barnes & Thornburg

[57] ABSTRACT

A tether assembly for tethering an object, which tether assembly includes a cable having opposite ends and a connector attached to one of the opposite ends, and a retaining block for securing the cable to a support. The retaining block includes two parallel through-bores which extend through the retaining block and are provided for receiving the cable. The retaining block also includes a stepped bore which has a threaded portion and a non-threaded terminal portion. The non-threaded terminal portion of the stepped bore has a cylindrical portion which terminates at a common intersection with each of the two parallel through-bores, and a tapered end. A spherical element is positionable in the non-threaded portion of the stepped bore. In use, the retaining block is secured to a support structure and the connector is connected to an object to be tethered. Next, the cable is looped through the two parallel through-bores and a threaded member is driven into the threaded portion of the stepped bore to press the spherical element against the cable. The tether assembly can be used to tether door security devices, outboard motors, trailers, and a variety of other objects.

17 Claims, 4 Drawing Sheets

TETHER ASSEMBLY

TECHNICAL FIELD

The present invention relates to door security devices which mechanically prevent a door from being opened. More particularly, the present invention relates to tether assemblies which are particularly useful for door security devices.

BACKGROUND ART

One-way doors, that is, doors that open by swinging in only one direction, are especially popular in commercial buildings, schools, and the like. They provide easy ingress and egress to and from the building. Out-swinging doors in schools and commercial buildings are often equipped with panic-bar handles. A panic-bar handle may include an elongated rod extending across the width of the door. By pushing against the rod, the door latch is released and the door may be opened. If a crowd of people are pushed up against the door, the weight of the crowd will depress the rod and the door will open. Similarly, if a person is in a hurry to open the door, the person need not stop to turn a conventional doorknob to unlatch the door. The person need only exert a force on the rod and the door will open.

One-way doors are also targets for burglars. Doors which open in an outward fashion can often be readily opened, even if locked. A pry bar or similar tool can be wedged between the door and the door frame, and the door can be pried open.

Thus, while the safety features of the out-swinging panic-bar door are desirable, the ease with which these doors may be broken into is a disadvantage. To reduce the threat of burglary, devices have been made which prevent out-swinging doors from being opened.

A number of devices designed to prevent out-swinging doors from being opened include detachable parts which are removed when such doors are to be opened. For example U.S. Pat. No. 3,819,216 to Richardson, U.S. Pat. No. 4,856,831 to Roden, Jr., U.S. Pat. No. 5,077,940 to LaRose, Jr., and U.S. Pat. No. 5,364,140 to Rice each disclose door security devices which include detachable braces that rest against a door frame and prevent the door from being opened. U.S. Pat. No. 3,863,968 to Fraser and U.S. Pat. No. 4,082,332 to Palmer disclose door security devices with detachable braces which are used in conjunction with in-swing doors.

It is not uncommon for the detachable braces of door security systems to be removed and lost, particularly in high crime areas wherein such braces are simply removed and stolen. Such braces have the potential of becoming weapons in the hands of burglars or other intruders.

Accordingly, a need exists for securing the removable parts of door security devices.

DISCLOSURE OF THE INVENTION

It is accordingly one object of the present invention to provide an assembly which will secure an object to a support.

It is another object of the present invention to provide a tether assembly which will secure an object to a support.

Another object of the present invention is to provide a tether assembly for securing removable parts of door security devices.

A further object of the present invention is to provide a tether assembly which will control the direction in which an object falls away from its operable position.

A further object of the present invention is to provide a tether assembly which is tamper-proof such that the assembly cannot be stolen.

A still further object of the present invention is to provide a tether assembly having a cable with an adjustable length.

According to these and further objects of the present invention which will become apparent as the description thereof proceeds below, the present invention provides tether assembly which includes:

- a cable having opposite ends and a connector attached to one of the opposite ends;
- a retaining block for securing the cable to a support, the retaining block including two parallel through-bores which extend through the retaining block and are provided for receiving the cable, and a stepped bore which includes a threaded portion and a non-threaded terminal portion, the non-threaded terminal portion having a cylindrical portion which terminates at a common intersection with each of the two parallel through-bores, and a tapered end; and
- a spherical element which is positionable in the non-threaded portion of the stepped bore.

The present invention also provides a security device for a door which includes a tether assembly for tethering a detachable element of the security device to a support structure.

The present invention further provides a method of tethering an object which involves;

- providing a cable having first and second opposite ends and a connector attached to the first end of the cable;
- connecting the connector to an object to be tethered;
- providing a retaining block having two parallel through-bores which extend through the retaining block and are provided for receiving the cable, and a stepped bore which includes a threaded portion and a non-threaded terminal portion, the non-threaded terminal portion having a cylindrical portion which terminates at a common intersection with each of the two parallel through-bores, and a tapered end;
- securing the retaining block to a support structure;
- passing the second end of the cable through each of the two parallel through-bores; and
- retaining the cable in the retaining block by driving a threaded member into the threaded portion of the stepped bore.

BRIEF DESCRIPTION OF DRAWINGS

The present invention will be described hereafter with reference to the attached drawings which are given as non-limiting examples only, in which.

BEST MODE FOR CARRYING OUT THE INVENTION

The present invention is directed to a tether assembly which includes a cable, means to adjustably secure one end of the cable and a connector on the free end of the cable. In use, the means to adjustably secure one end of the cable is attached to a stationary support and the connector on the free end of the cable is attached to an object which is to be tethered to the stationary support.

The tether assembly of the present invention is hereafter described for use in conjunction with a door security device. However, the tether assembly is useful for securing various objects, such as outboard motors to boats, trailers to vehicles, and similar objects which are conventionally secured with safety chains. The tether assembly of the present invention is particularly useful in applications which require frequent adjustment of the length of the tether cable.

The cable used in the tether assembly should be of a sufficient strength to support the anticipated weight and force of the object to be tethered. For security purposes, the cable should be made from a material such as stainless steel which is difficult to cut.

The connector on the free end of the cable needs to be securely attached to the free end of the cable so that it can support the anticipated weight of the object to be tethered, together with any anticipated forces associated with the object falling against the tether or otherwise being jerked.

The connector can be clamped or welded onto the free end of the cable or attached by any suitable means. In a preferred embodiment of the present invention, the connector is die cast onto the free end of the cable.

Any convenient type connector that can be secured to the object to be tethered can be used, including, but not limited to eyelets, hooks, snap hooks, clips, mechanical fasteners, etc.

The means for adjustably securing one end of the cable to a stationary support includes a retainer though which the cable can be passed and by which the cable passing therethrough can be gripped. In a preferred embodiment, the retainer comprises a retaining block which has one or more through-bores or channels through which the cable can pass. A retaining element presses against the cable positioned in the bore or bores and causes the cable to be securely gripped by the retaining block. The retaining block includes means for securing the retaining block to a stationary support. Such securing means preferably includes through-bores, through which suitable screws or bolts can be passed to fasten the retaining block to a stationary support.

Figure 1:
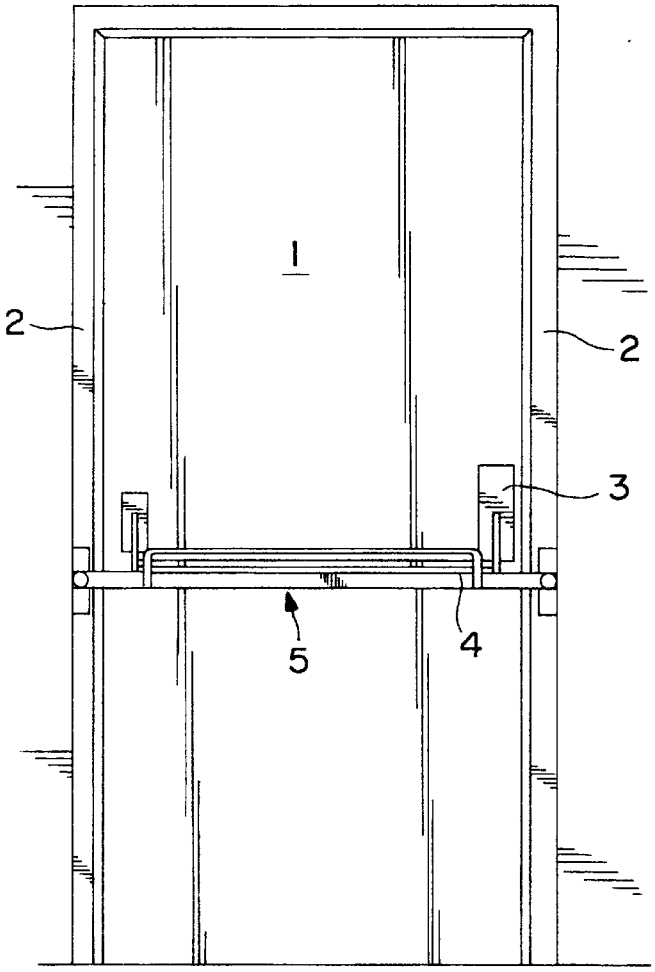
FIG. 1 PRIOR ART
FIG. 1 is a front view of a prior art door security device, shown mounted to a door.

FIG. 1 is a front view of a prior art door security device, shown mounted to a door. This particular device is disclosed in U.S. Pat. No. 5,364,140, the complete disclosure of which is expressly incorporated herein by reference. Door 1 is typically mounted within door frame 2. Panic-bar handle assembly 3 includes rod 4, which extends substantially horizontally across the width of door 1. Security device 5 is positioned across the door frame 2, parallel to rod 4 as depicted.

Figure 2:
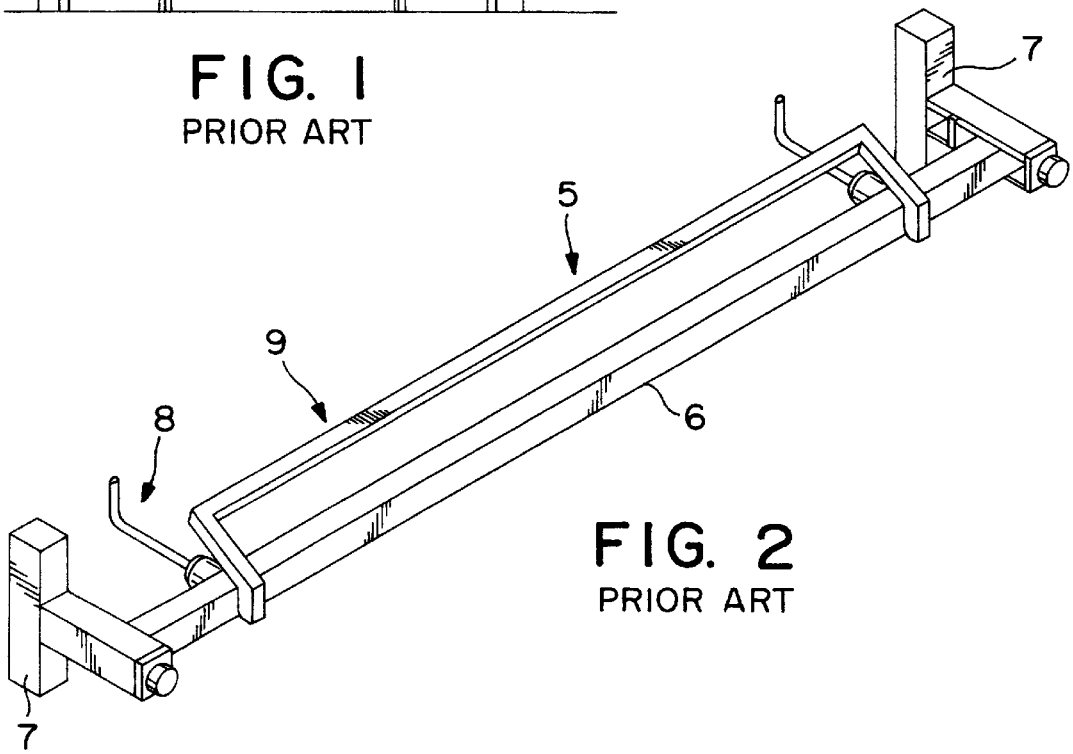
FIG. 2 PRIOR ART
FIG. 2 is a perspective view of the prior art door security device of FIG. 1.

FIG. 2 is a perspective view of the prior art door security device of FIG. 1. As can be seen in FIG. 2, security device 5 includes support bar 6 which is supported against a door frame 2 by blocking members 7. Security device 5 also includes an attachment means 8 by which the device can be attached to a door, and an actuation mechanism 9 which is used to engage and disengage the device from a door. Blocking members 7 are designed to abut and rest flush against door frame 2.

In normal use, the security device 5 depicted in FIGS. 1 and 2 is positioned so that blocking members 7 rest against a door frame 2 and attachment means 8 attaches the device to rod 4 of the panic-bar assembly 3. In this position the door 1 is prevented from being opened from the outside. During an emergency, pushing on the actuation mechanism 9 causes the security device 5 to become detached from rod 4 and fall to the floor.

Figure 3:
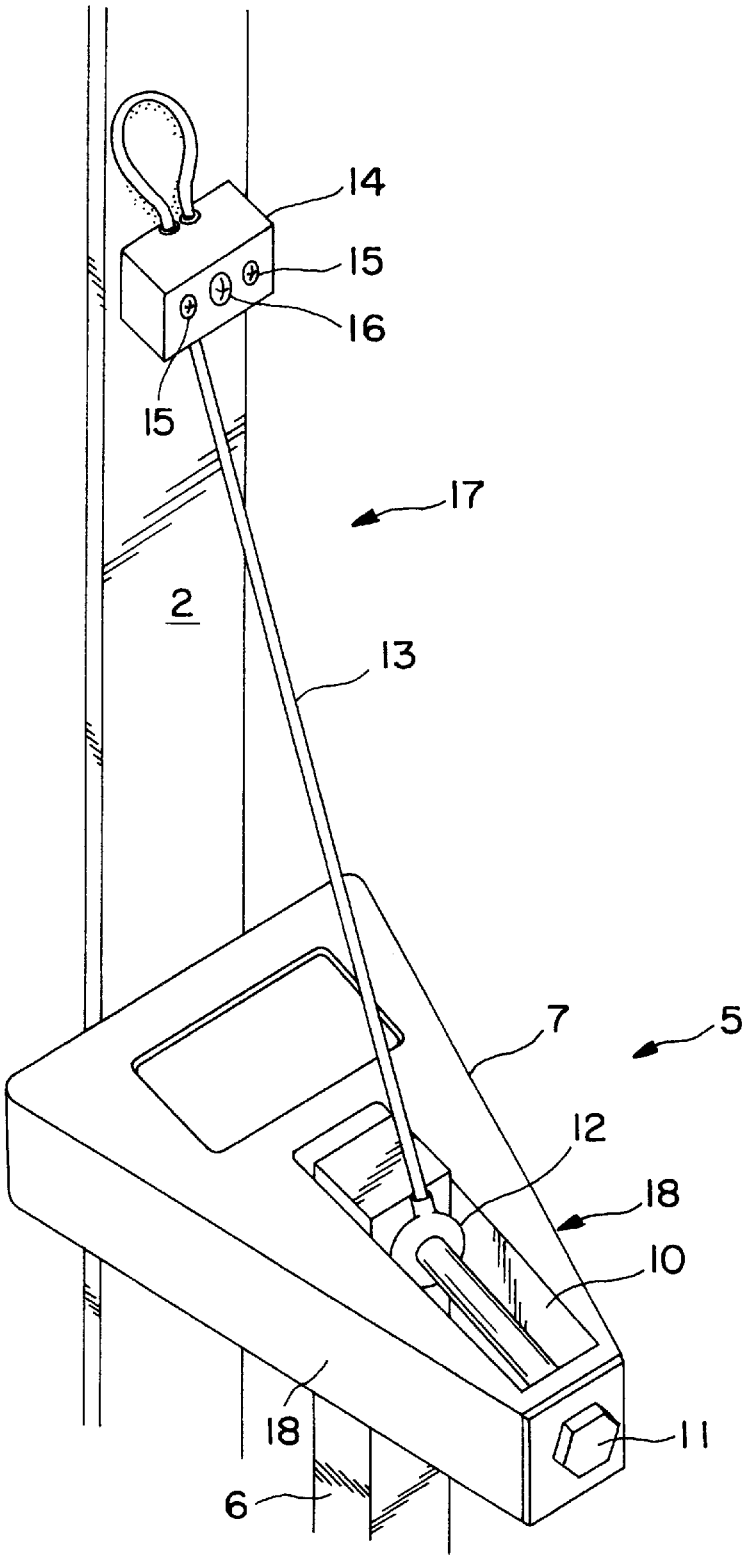
FIG. 3 is a perspective view of a tether assembly according to one embodiment of the present invention attached to a modified blocking member of a door security system.

FIG. 3 is a perspective view of a tether according to one embodiment of the present invention attached to a modified blocking member of a door security system. As shown in FIG. 3, the tether assembly 5 of the present invention includes a retaining block 14 which can be secured to a stationary support such as door frame 2, a length of cable 13 and a connector 12 attached to the free end of cable 13.

FIG. 3 depicts a blocking member 7 which can be used in conjunction with the security device of FIGS. 1 and 2. The illustrated blocking member 7 is provided with a slot 10 though which bolt 11 can be accessed from the outside so that when connector 12 is fitted on bolt 11, the cable 13 extends through the side of blocking member 7. Element 6 in FIG. 3 is the support bar used in the prior art security device of FIGS. 1 and 2.

The retaining block 14 is secured to door frame 2 by screws 15 which extend through through-bores in retaining block 14 and are embedded into the door frame 2. Other means of securing the retaining block 14 to the door frame 2 can be used including, bolts, pins, etc. Tamper-proof means are generally recommended to secure the retaining block 14 to the door frame 2. In new installations, the retaining block 14 may be welded onto a metal door frame 2 or otherwise formed integral therewith.

A retaining means for retaining cable 13 in retaining block 14 includes a threaded member 16 which is discussed in more detail below. Also discussed below is the manner in which the retaining block 14 "adjustably" secures cable 13.

The connector 12 attached to the free end of cable 13 is depicted as being an eyelet through which bolt 11 of blocking member 7 passes. As discussed above, any convenient type of connector, including, but not limited to eyelets, hooks, snap hooks, clips, mechanical fasteners, etc. can be used.

In FIG. 3, the door security device 5 is depicted in the manner in which it would be supported by tether assembly 17 after pushing on actuation mechanism 9, disengaging the security device 5, and allowing the device to fall from a doorway. As depicted, the tether assembly 17 prevents the security device 5 from falling to the ground, where it might be lost or even tripped over in an emergency situation. As can be appreciated from FIG. 3, the tether assembly 17 actually functions to pull the falling security device 5 toward the door frame 2 and thus out of the path of the opened door.

The slot or channel 10 formed in blocking member 7 allows access of the cable 13 and fitting 12 onto bolt 11 in such a manner that the security device 5 does not become tangled in the cable 13 as the security device 5 is released and falls. Not shown in FIG. 3 is the inside of blocking member 7 which may include channels in arms 18. Otherwise, arms 18 can be solid.

Figure 4:
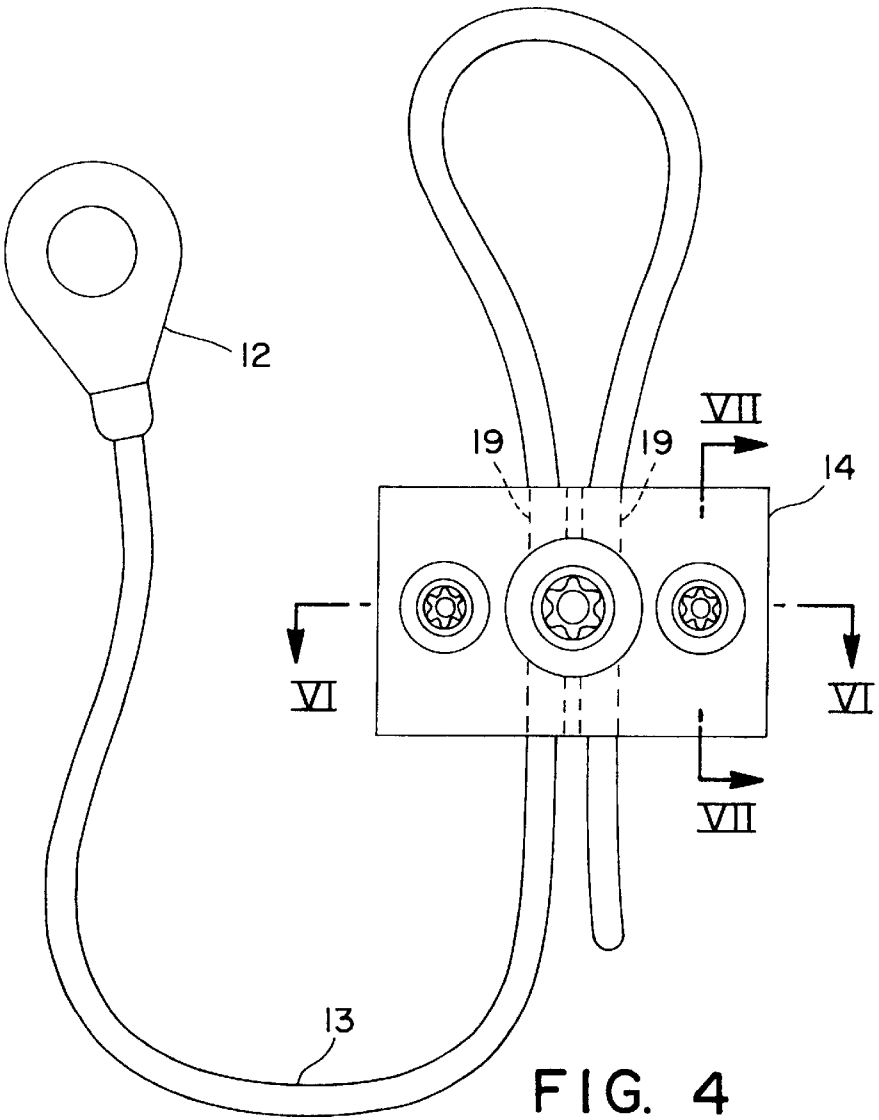
FIG. 4 is a schematic view of a tether assembly according to one embodiment of the present invention.

FIG. 4 is a schematic view of a tether assembly according to one embodiment of the present invention. FIG. 4 shows the manner in which cable 13 is "adjustably" secured by retaining block 14. As depicted, the retaining block 14 includes two parallel through-bores 19 which have an inside diameter which is slightly larger than the outside diameter of cable 13. Bores 19 are provided to receive cable 13. As shown, the end of the cable 13 which does not include the connector is looped through through-bores 19, and secured therein as described below. The retaining block 14 is considered to "adjustably" secure cable 13, because the length of the cable 13 between connector 12 and retaining block 14 can be suitably adjusted before the cable 13 is secured in retaining block 14, by the retaining means.

Figure 5:
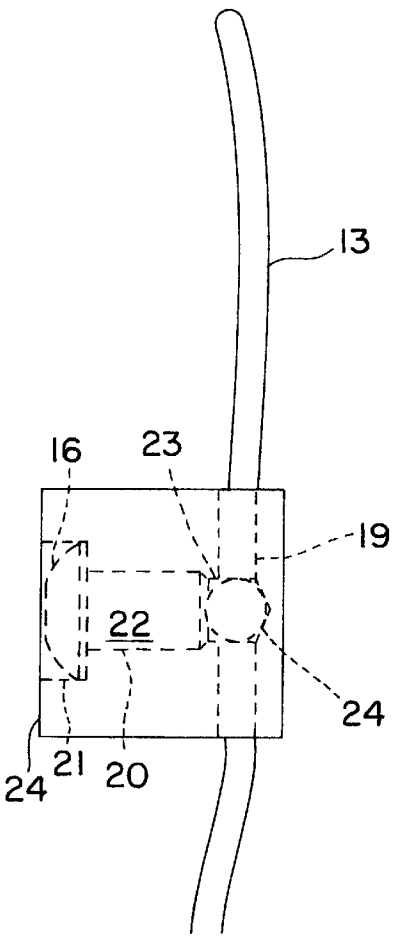
FIG. 5 is a side view of the retaining block of the tether assembly of FIG. 4.

FIG. 5 is a side view of the retaining block of the tether assembly of FIG. 4. FIG. 5 depicts a stepped bore 20 which intersects through-bores 19. Stepped bore 20 includes stepped surface portion 21 into which a threaded element such as a screw 16 can be countersunk flush or below surface 24, an intermediate threaded portion 22 which cooperates with screw 16, and a terminal portion 23 which is sized to receive a ball bearing 24. The end of the terminal bore portion 23 is preferably tapered as depicted by the phantom lines in FIG. 5.

Figure 6:
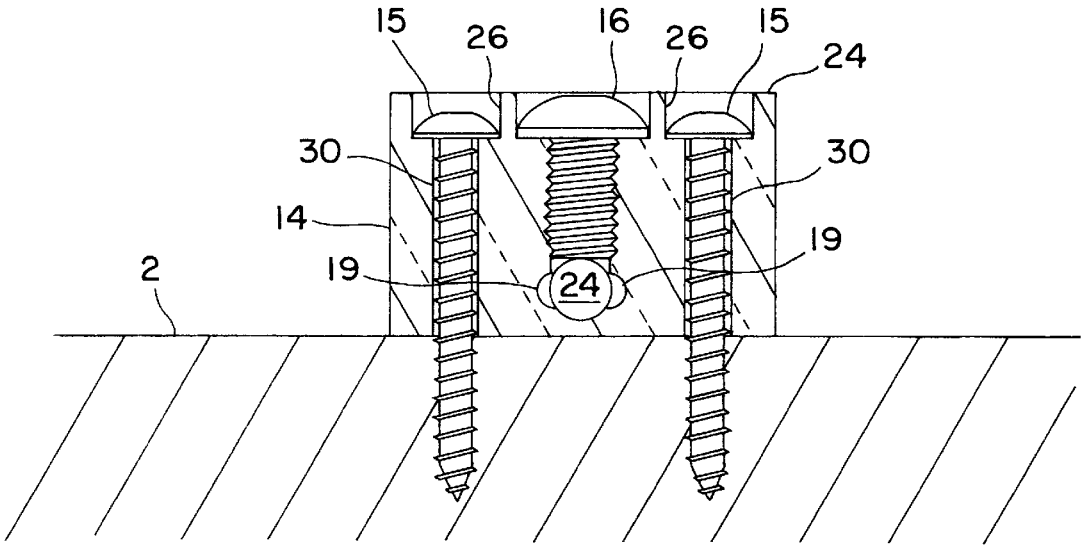
FIG. 6 is a cross-sectional view of the retaining block of FIG. 4 taken along line VI—VI.

FIG. 6 is a cross-sectional view of the retaining block of FIG. 4 taken along line VI—VI. FIG. 6 depicts how the a pair of through-bores 30 are provided and used to secure the retaining block 14 on to a support 2 which can be a door, door frame, wall, etc. Through-bores 30 have stepped portions 26 at surface 24 which allow the screws 15 to be countersunk therein. Countersinking screws 15 and retaining screw 16 below surface 24 of retaining block 14 prevents the heads of these screws from being exposed and possibly cut-off by vandals.

The manner in which stepped bore 20 intersects through-bores 19 is shown in FIG. 6. Also shown is the position of ball bearing 24 when it is pushed toward the bottom of stepped bore 20 by retaining screw 16. As the ball bearing 24 is pushed toward the bottom of stepped bore 20, the cable 13 positioned in through-bores 19 is displaced outward by the curved surfaces of the ball bearing. The portion of the cable 13 which passes through through-bores 19 becomes displaced and thus securely gripped by the retaining means which includes retaining screw 16 and ball bearing 24.

In a preferred embodiment, which is illustrated in the drawings, through-bores 19 which receive cable 13 have a continuous inside diameter. Thus, when cable 13 is displaced by ball bearing 24, the cable 13 does not become deformed so that it cannot slide through through-bores 19 once retaining screw 16 is retracted and ball bearing 24 loosened. Likewise, because of the smooth surface of ball bearing 24, the cable 13 is not pierced at any point so that it becomes weakened.

Figure 7:
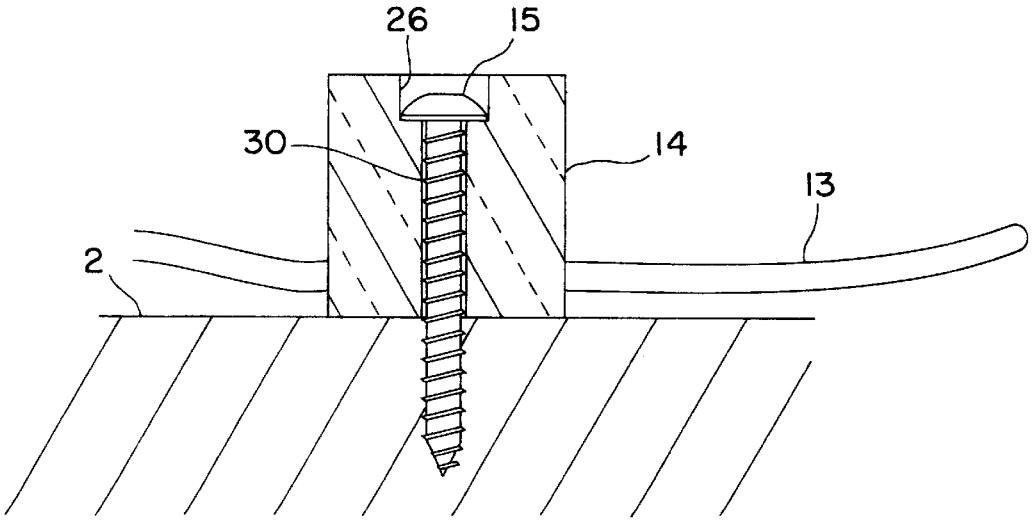
FIG. 7 is a cross-sectional view of the retaining block of FIG. 4 taken along line VII—VII.

FIG. 7 is a cross-sectional view of the retaining block of FIG. 4 taken along line VII—VII. FIG. 7 depicts one of the screws 15 used to secure the retaining block 14 to a support structure 2.

The tether assembly of the present invention is preferably made from materials which are resistant to tampering, cutting, corrosion, and other destructive conditions when used to secure door security devices. For example, cable 13, retaining block 14, connector 12, screws 15, retaining screw 16, and ball bearing 24 can be made of carbon or stainless steel or other suitable materials. It has been found particularly useful to make retaining block 14 out of aluminum because of the ease of machining aluminum and the ability of the retaining screw 16 to grip into aluminum.

In use, a suitable support structure is located near where the object to be tethered is used, and the retaining block 14 is secured to the support structure by suitable mechanical fasteners, such as screws 27, welding, cementing, epoxying, etc. A suitable support is one that will withstand any anticipated jerk force exerted if the tethered object is allowed to fall. Also, the location of the retaining block 14 should be chosen based upon any preference as to where the tethered object should be allowed to fall and remain suspended. For example, in the case of a door security device, it is preferred to locate the retaining block 14 at a point on the door frame that will prevent the security device from blocking the pathway to the opened door.

Next, the connector 12 is attached to the object to be tethered. As in the case of determining where to best attach the retaining block 14, the connector should be attached to the object to be tethered at a point which will prevent the cable 13 from being tangled when the object drops, and at a point from which the object can conveniently hang if possible. It is also important to attach the connector 12 to a part of the object which will not break or become damaged when the object falls and is jerked by the tether assembly.

Once the connector 12 is attached to the object to be tethered, the other end of the cable 13 is looped through through-bores 19 in retaining block 14 as depicted in the figures. The length of the cable between connector 12 and retaining block 14 is "adjusted" before the cable 13 is retained in retaining block 14. The length of cable 13 between connector 12 and retaining block 14 should be selected by considering how the tethered object will hang by the cable 13. For example, in the case of tethering a door security device, the length of cable between connector 12 and retaining block 14 should be short enough to prevent the door security device from reaching and hitting the floor when it falls. In some applications it may be best to "adjust" the length of cable 13 between connector 12 and retaining block 14 while the tethered object is allowed to hang from the retaining block 14.

The cable 13 is retained in the retaining block 14 by driving retaining screw 16 into stepped bore 20 and forcing ball bearing 24 into the terminal portion of the stepped bore 20 so that the cable 13 in through-bores 19 is displaced by the ball bearing 24.

As can be appreciated from the above description, the tether assembly of the present invention, although particularly useful for use in conjunction with door security devices, is not limited to any particular use. That is, the tether assembly could be used for tethering outboard motors to boats, trailers to trailer hitches, and other applications which normally involve the use of safety chains or security cables.

According to a further embodiment of the present invention, a spring, which may be shielded to prevent cutting or other tampering, may be secured to an intermediate position of the cable 13 between the connector 12 and the retaining block 14. Such a spring would absorb a portion of the jerk force experienced by the tether assembly which occurs when the tethered object drops.

According to another embodiment, the cable 13 and connector 12 may have a coating of a material such as a plastic or rubber which will prevent the tether assembly from scratching or marring adjacent surfaces of structures.

Although not illustrated, it is possible to use retaining block 14 to secure two tether cables 13. This can be accomplished by inserting two cables into through-bores 19. Such a modification can be used to tether two door security devices which are used on an adjoining pair of doors. Of course, it is possible to provide retaining block 14 with two pairs of through-bores 19 and two retaining screws 16, if desired.

Although the present invention has been described with reference to particular means, materials and embodiments, from the foregoing description, one skilled in the art can easily ascertain the essential characteristics of the present invention and various changes and modifications may be made to adapt the various uses and characteristics without departing from the spirit and scope of the present invention as described by the claims which follow.

What is claimed:

1. A tether assembly which comprises:

a cable having opposite ends and a connector attached to one of said opposite ends;

a retaining block for securing said cable to a support, said retaining block including two parallel through-bores which extend through said retaining block and are provided for receiving said cable, and a stepped bore which includes a threaded portion and a non-threaded terminal portion, said non-threaded terminal portion having a cylindrical portion which terminates at a common intersection with each of said two parallel through-bores and a tapered end; and a spherical element which is positionable in the non-threaded portion of said stepped bore.

2. A tether assembly according to claim 1, wherein said stepped bore is perpendicular to said two parallel through bores.

3. A tether assembly according to claim 1, wherein said stepped bore includes a stepped surface portion for countersinking a retaining screw.

4. A tether assembly according to claim 1, wherein said spherical element comprises a ball bearing.

5. A tether assembly according to claim 1, wherein said retaining block includes means for securing said retaining block to said support.

6. A tether assembly according to claim 5, wherein said means for securing said retaining block comprises two additional through-bores for receiving mechanical fasteners therethrough.

7. A tether assembly according to claim 6 wherein said two additional through-bores are parallel to said stepped bore.

8. A tether assembly according to claim 7 wherein said two additional through-bores have stepped surface portions.

9. A tether assembly according to claim 1, wherein said connector is die cast onto said cable.

10. A tether assembly according to claim 9, wherein said connector comprises an eyelet.

11. In a security device for a door which includes an element that is detachable for opening said door, the improvement comprising a tether assembly for tethering said detachable element to a support structure, said tether assembly including:

a cable having opposite ends and a connector attached to one of said ends; and a retaining block for securing said cable to said support structure, said retaining block including:

two parallel through-bores which extend through said retaining block and are provided for receiving said cable; and a stepped bore which includes a threaded portion and a non-threaded terminal portion, said non-threaded terminal portion having a cylindrical portion which terminates at a common intersection with each of said two parallel through-bores, and a tapered end.

12. A security device for a door according to claim 11, wherein said support structure comprises a door frame.

13. A security device for a door according to claim 11, wherein said detachable element comprises a support bar having blocking members on opposite ends thereof and said connector is attached to one of said blocking members.

14. A security device for a door according to claim 11, further including a spherical element which is positionable in the non-threaded portion of said stepped bore.

15. A method of tethering an object which comprises;

providing a cable having first and second opposite ends and a connector attached to the first end of said cable;

connecting said connector to a object to be tethered;

providing a retaining block having two parallel through-bores which extend through said retaining block and are provided for receiving said cable, and a stepped bore which includes a threaded portion and non-threaded terminal portion, said non-threaded terminal portion having a cylindrical portion which terminates at a common intersection with each of said two parallel through-bores, and a tapered end;

securing said retaining block to a support structure;

passing the second end of said cable through each of said two parallel through-bores; and retaining said cable in each of said two parallel through-bores of said retaining block by driving a threaded member into said threaded portion of said stepped bore.

16. The method of claim 15, wherein said retaining further comprises providing a spherical element between said cable in said two parallel through-bores and said threaded member before driving said threaded member into said threaded portion of said stepped bore.

17. The method of claim 15, wherein said object is a door security system.

* * * * *